US006382064B1

(12) United States Patent
Dugger

(10) Patent No.: US 6,382,064 B1
(45) Date of Patent: May 7, 2002

(54) APPARATUS AND METHOD FOR TRIMMING FORMED ELEMENTS

(75) Inventor: Ben A. Dugger, Pell City, AL (US)

(73) Assignee: Modern Technologies & Machinery, Inc., Oxford, AL (US)

( * ) Notice: Subject to any disclaimer, the term of this patent is extended or adjusted under 35 U.S.C. 154(b) by 0 days.

(21) Appl. No.: 09/439,214

(22) Filed: Nov. 12, 1999

(51) Int. Cl.[7] ..... B26D 7/06

(52) U.S. Cl. ..... 83/453; 83/422; 83/424; 83/437.3; 83/694; 83/914; 164/262

(58) Field of Search ..... 83/914, 690, 694, 83/456, 51, 639.1, 437.3, 424, 422, 123–125, 136, 453, 102, 461; 164/262, 265

(56) References Cited

U.S. PATENT DOCUMENTS

| | | | | |
|---|---|---|---|---|
| 2,496,131 A | | 1/1950 | Morin et al. | |
| 3,495,650 A | | 2/1970 | Perrella | |
| 4,041,821 A | * | 8/1977 | Galter | 83/382 |
| 4,665,785 A | | 5/1987 | Thurner | |
| 4,886,106 A | | 12/1989 | Bennett | |
| 4,991,479 A | * | 2/1991 | Asano et al. | 83/152 |
| 4,997,162 A | * | 3/1991 | Baker et al. | 251/327 |
| 5,163,223 A | * | 11/1992 | Wurster | 29/874 |
| 5,343,929 A | | 9/1994 | Landua et al. | |
| 5,556,649 A | | 9/1996 | Sumioka et al. | |
| 5,996,456 A | * | 12/1999 | Streck | 83/123 |

* cited by examiner

*Primary Examiner*—Boyer Ashley
(74) *Attorney, Agent, or Firm*—Robert J. Veal; Christopher A. Holland; Burr & Forman LLP

(57) ABSTRACT

A formed element trimming apparatus includes a base member, a nesting member connected to a ram cylinder mounted on one end of the base member, a clamping member connected to a clamping cylinder mounted to a second end of the base member, and a cutting plate attached to the base member between the nesting member and the clamping member. The cutting plate has a cutting aperture to engage any undesired attachments on the periphery of the formed element. The formed element is securely placed in the nesting member, which is designed to integrally receive the formed element. The clamping member, propelled by the clamping cylinder, traverses the cutting aperture to engage the nesting member and secure the position of the formed element between the nesting member and the clamping member. The ram cylinder is then activated to overpower the clamping cylinder and force the nesting member and clamping member back through cutting aperture such that the any undesired attachments on the periphery of the formed element will contact the periphery of the cutting aperture to truncate such undesired attachments from the formed element. The apparatus may further include an auxiliary apparatus to trim the formed element in a second dimension.

15 Claims, 8 Drawing Sheets

APPARATUS AND METHOD FOR TRIMMING FORMED ELEMENTS

FIELD OF THE INVENTION

The present invention relates to trimmers for formed elements, such as castings, forgings, and similar elements, and, more particularly, to an apparatus and method for efficiently trimming burrs, fins, parting lines, and other undesired attachments from the surface of a formed element, such as a casting, forging, or similar element.

BACKGROUND OF THE INVENTION

A common problem occurring with the production of formed elements is that undesired rough edges, such as burrs, and other undesired attachments, such as fins or parting lines, frequently remain on the formed element after the formed element has been cast, forged, or formed, and subsequently cut. The rough edges and undesired attachments can cause problems when the formed element is ready to be installed in the intended apparatus in that the imperfect formed element may prevent the apparatus from operating as required. As a result, it is necessary that each burr, fin, parting line, or other undesired attachment be removed from the formed element before the formed element is to be used.

Several trimmer designs have been developed in an attempt to easily remove such undesired attachments on the surface of the formed element. A conventional way to trim a formed element is done via a four post press or a similar "C" frame press. These conventional presses generally consist of a cutter die and a nest to contain the formed element. The formed element is loaded directly into the nest either by hand, a shuttle car, or a turn table, and the cutter die strokes down. The burr is then stripped off, and then the cycle is repeated by retracting the cutter die from around the formed element. A problem with such designs is that the cutter die experiences significant amounts of wear and is not capable of easily being sharpened. Additionally, the formed element is also not discharged automatically, and therefore must be removed by hand or by a specially designed means.

A series of patents describe different devices that are used to remove burrs from castings. For example, in U.S. Pat. No. 5,343,929 to Landua, et al., an apparatus is described for deburring foundry cores. This design provides a press to remove burrs from the foundry core. However, such a device is unable to engage the total periphery of the core to remove bores. The design includes an elastic gripping member to hold and support the core, which prevents the press from completely engaging the outer periphery of the core. Furthermore, this device requires a vibrating means to remove the burrs, which makes it more complicated to design and maintain. As a result, such a design is more complex and does not function to exhaustively deburr the core.

What is needed, then, and not found in the prior art, is an apparatus and method for efficiently removing any undesired attachments present on a formed element such that the entire periphery of the formed element is trimmed and cleaned, and including a cutting plate that is easily sharpened or replaced as necessary for various formed elements.

SUMMARY OF THE INVENTION

An object of the present invention is to provide an apparatus for removing undesired attachments from a formed element.

A further object of the present invention is to provide an apparatus for removing undesired attachments from a formed element with an easily replaceable cutting plate.

A further object of the present invention is to provide an apparatus able to remove undesired attachments from multiple shapes of formed elements.

A further object of the present invention is to provide an apparatus for removing undesired attachments from multiple surfaces of a formed element.

A further object of the present invention is to provide an apparatus for removing undesired attachments from a formed element such that the formed element is held securely to prevent rotation of the formed element while traversing a cutting aperture.

These and other objects of the invention are accomplished through the present apparatus and method for trimming formed elements. This apparatus includes a nesting member for receiving a formed element attached to a ram cylinder and a clamping member attached to a clamping cylinder. Positioned between the nesting member and the clamping member is a cutting plate having a cutting aperture that is designed to engage any undesired attachments connected to the formed element. A formed element to be trimmed may be placed in the nesting member, and the clamping member may then be extended linearly though the cutting aperture to engage the formed element resting in the nesting member. The ram cylinder then extends to overpower the clamp cylinder and push the nesting member and the clamping member through the cutting aperture. The cutting aperture is designed such that the undesired attachments connected to the formed element will be trimmed upon passing through the cutting aperture. The clamping cylinder exerts a stabilizing force to prevent the formed element from rolling or twisting while the formed element traverses the cutting aperture. Once the nesting member has passed through the cutting aperture, the clamping member retracts, which allows the trimmed formed element to fall or be extracted.

BRIEF DESCRIPTION OF THE DRAWINGS

An apparatus and method for trimming formed elements embodying the features of the present invention is depicted in the accompanying drawings which form a portion of this disclosure and wherein.

DESCRIPTION OF THE PREFERRED EMBODIMENTS

Figure 1A:
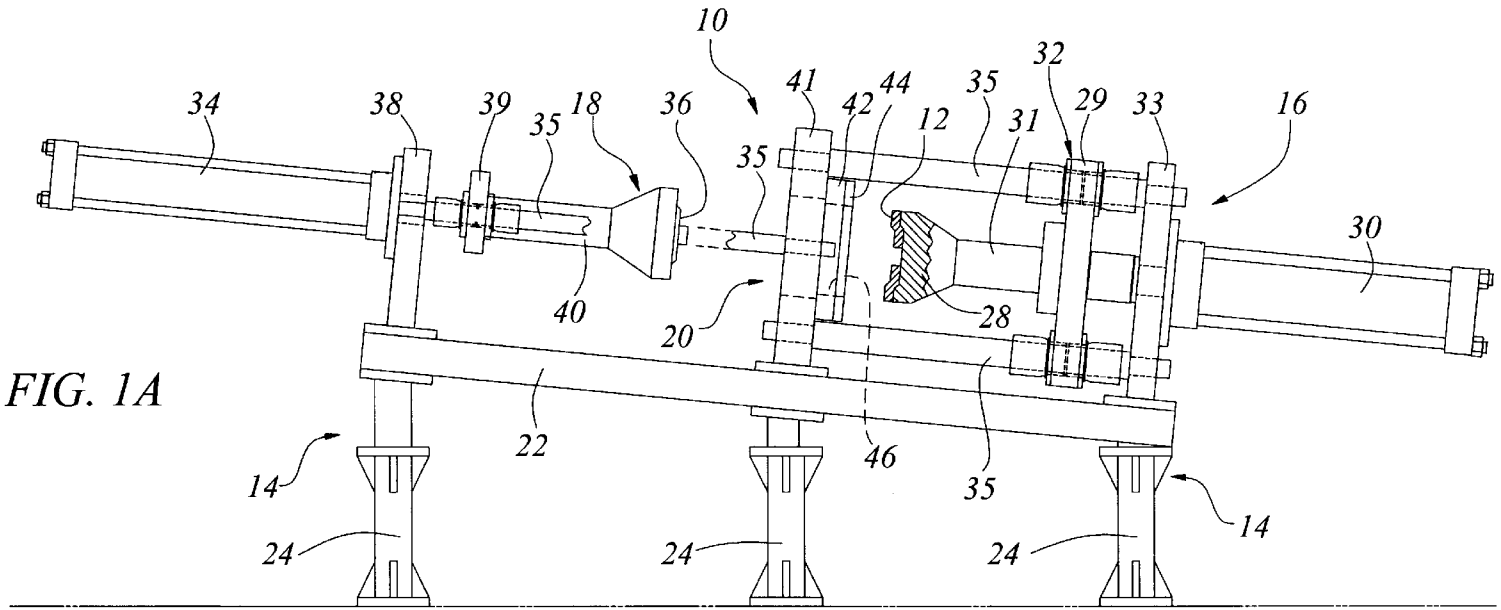
FIG. 1A is a front elevational view of the apparatus for trimming formed elements of the present invention, the nesting member and formed element shown as a sectional view.
Figure 1B:
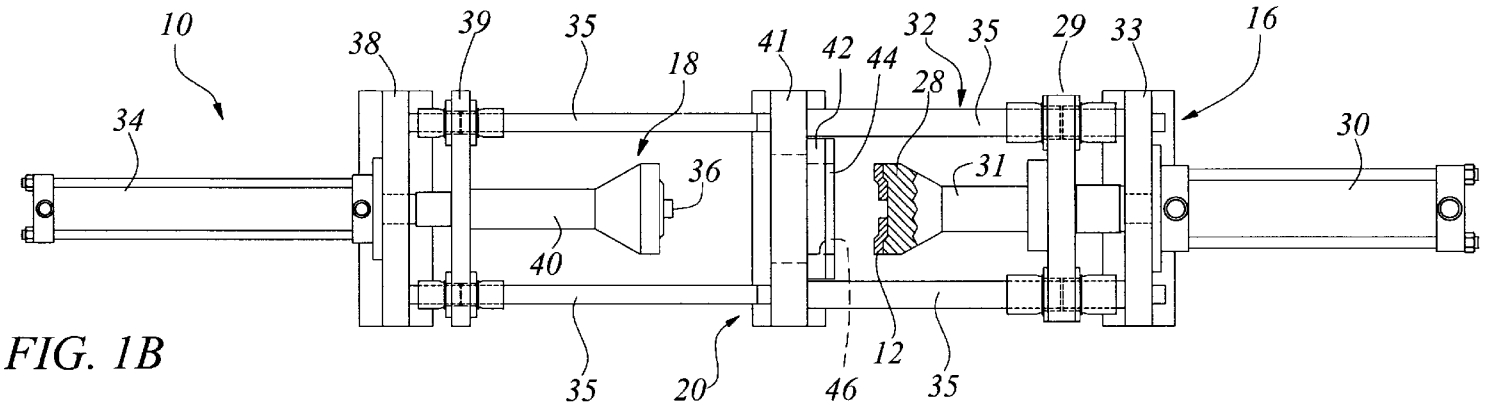
FIG. 1B is a top plan view of the apparatus for trimming formed elements of the present invention as illustrated in FIG. 1A.
Figure 2:
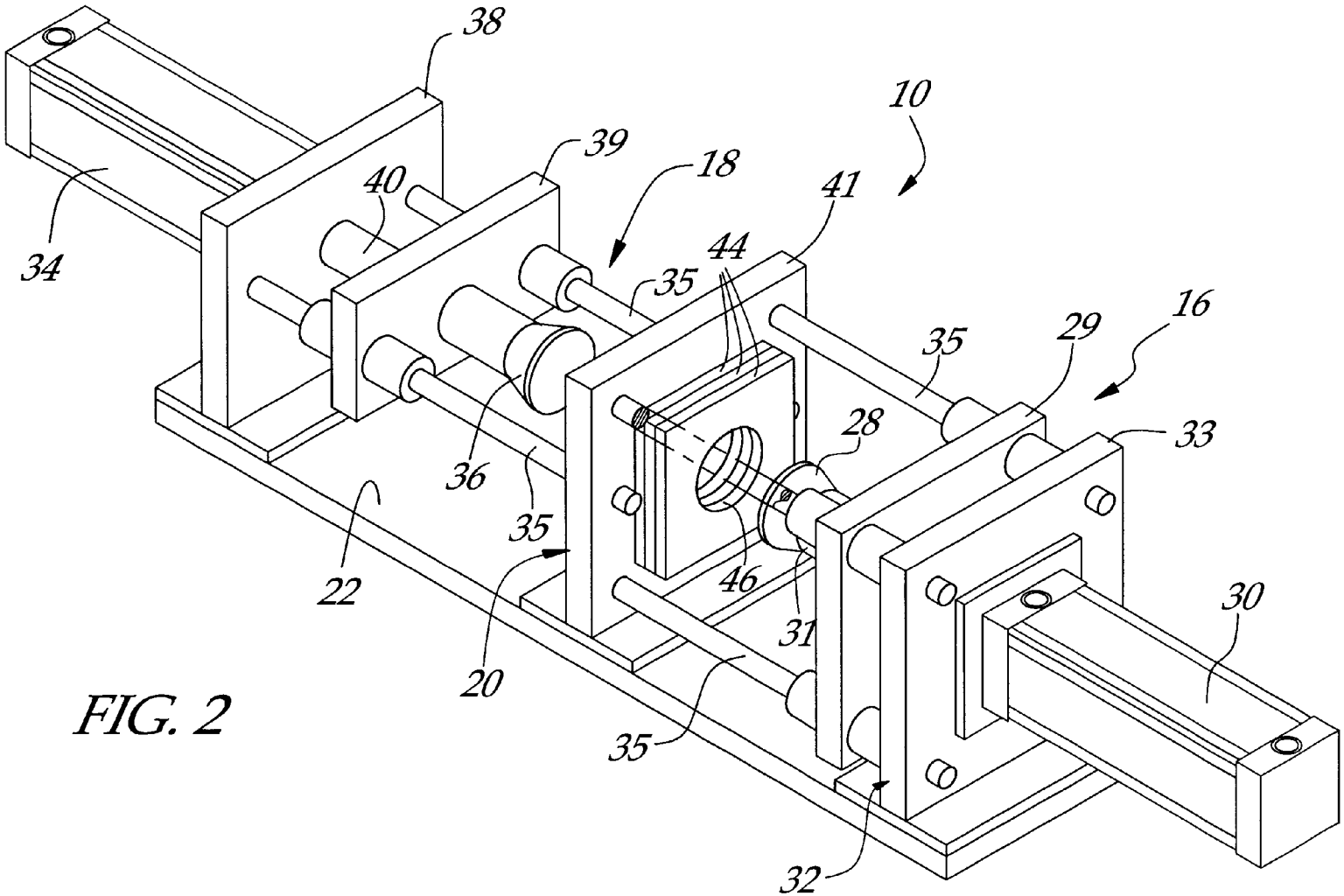
FIG. 2 is a perspective view of the entry side of the cutting means of the present invention.
Figure 3:
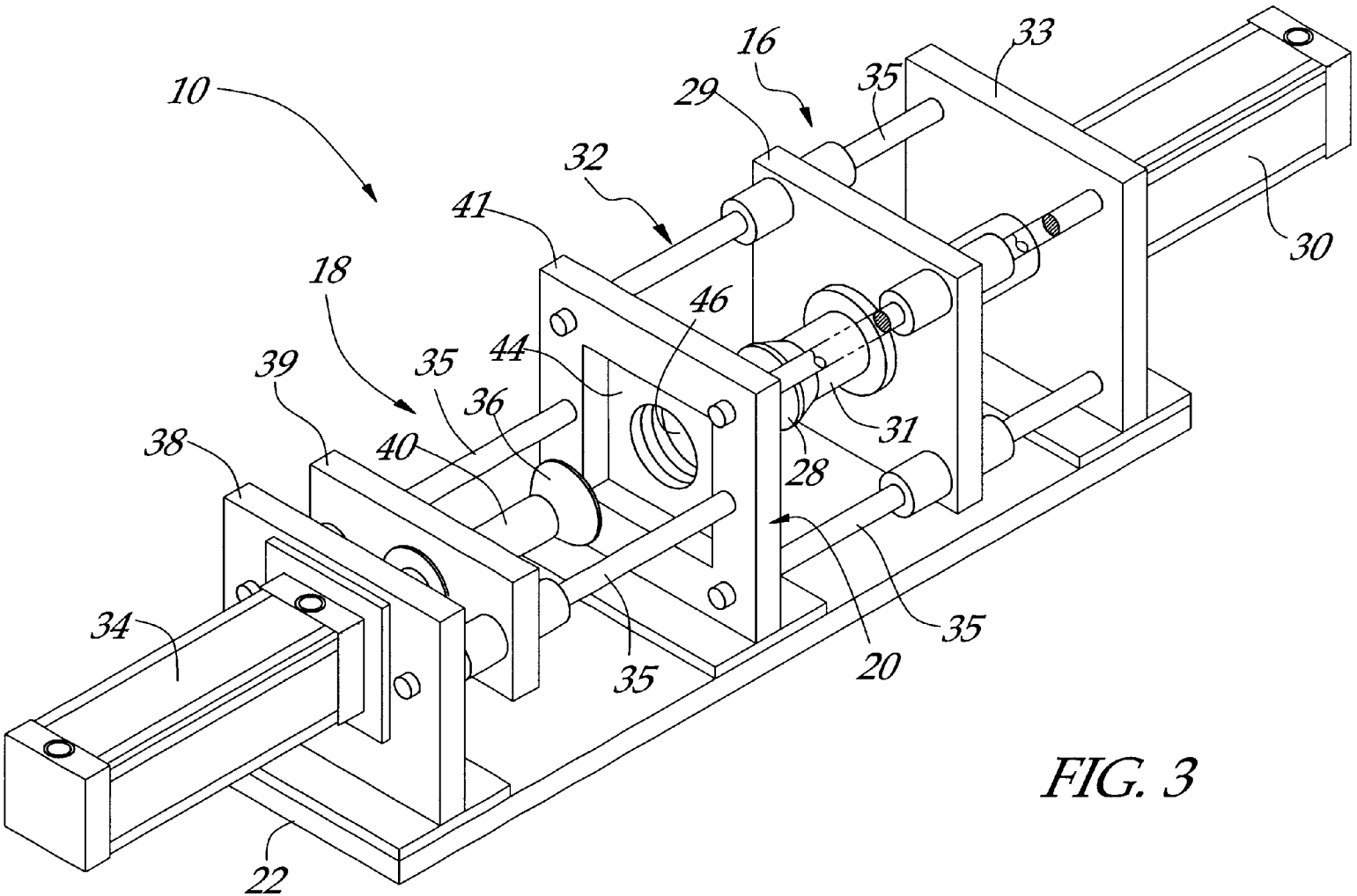
FIG. 3 is a perspective view of the exiting side of the cutting means of the present invention.
Figure 7A:
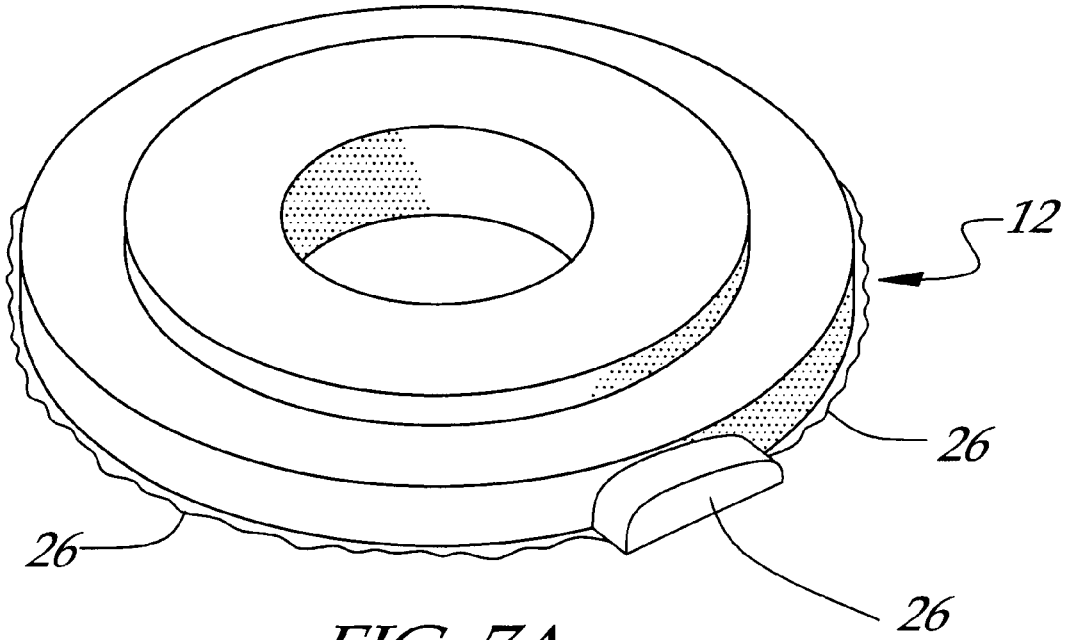
FIG. 7A is a perspective view of the formed element having a fin to be trimmed by the present invention.
Figure 7B:
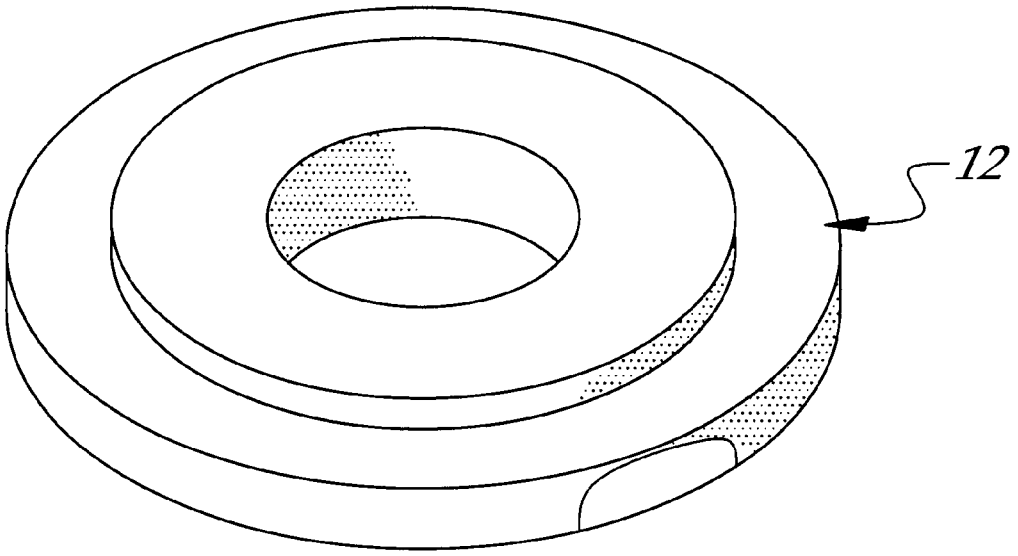
FIG. 7B is a perspective view of the formed element after having been trimmed by the present invention.

Looking at FIGS. 1A and 1B, an apparatus 10 for trimming formed elements 12 is illustrated including a base member 14, a formed element receiving means 16, a clamping means 18, and a cutting means 20. The base member 14 serves as the supporting foundation for the other elements, and it includes a table member 22 supported by a plurality of leg members 24. A frame 32 is attached to the table member 22, and the frame 32 is used to secure the formed element receiving means 16, clamping means 18, and cutting means 20 to the table member 22. The frame 32 includes a first brace 33, a second brace 38, and a third brace 41, and each brace 33, 38, and 41 is joined together via a series of guide rods 35. The cutting means 20 is thereby positioned between the formed element receiving means 16 and the clamping means 18 on the frame 32 such that the elements are able to interact with each other and thereby remove any undesired attachments 26, such as ingates, burrs, fins, or parting lines, from the periphery of the surface of a formed element 12 (see FIGS. 7A and 7B).

Looking at FIGS. 1A, 1B, 2, and 3, the formed element receiving means 16 is designed to secure the position of the formed element 12 before the formed element 12 is trimmed. The formed element receiving means 16 includes a nesting member 28, a ram cylinder 30, a ram cylinder rod 31, and a nesting positioning plate 29. The first brace 33 of the frame 32 supports the ram cylinder 30, which is a conventional hydraulic cylinder. The ram cylinder rod 31 acts as a conventional piston rod used by the ram cylinder 30, such that the ram cylinder rod 31 is able to be linearly extended and retracted by the ram cylinder 30.

The nesting member 28 is attached to a cantilevered end of the ram cylinder rod 31, and the nesting member 28 is designed to securely and integrally grip the formed element 12. As a result, the ram cylinder 30 will provide linear movement of the ram cylinder rod 31 to extend and retract the nesting member 28 holding the formed element 12. Additionally, the nesting positioning plate 29 is slidably mounted on the guide rods 35 and serves as a support member for the ram cylinder rod 31 such that the ram cylinder rod 31 does not vary from its desired path.

The apparatus 10 for trimming formed elements 12 further includes a clamping means 18 that is used to contact the formed element 12 positioned on the nesting member 28 to secure the position of the formed element 12 on the nesting member 28. The clamping means 18 includes a clamping member 36, a clamping cylinder 34, a clamping cylinder rod 40, and a clamping positioning plate 39. The second brace 38 of the frame 32 supports the clamping cylinder 34, which is a conventional hydraulic cylinder. The clamping cylinder rod 40 acts as a conventional piston rod used by the clamping cylinder 34, such that the clamping cylinder rod 40 is able to be linearly extended and retracted by the clamping cylinder 34. The clamping member 36 is attached to a cantilevered end of the clamping cylinder rod 40, and the clamping member 36 is designed to securely and integrally engage the formed element 12 and nesting member 28. As a result, the clamping cylinder 34 will provide linear movement of the clamping cylinder rod 40 to extend and retract the clamping member 36. Additionally, the clamping positioning plate 39 is slidably mounted on the guide rods 35 and serves as a support member for the clamping cylinder rod 40 such that the clamping cylinder rod 40 does not vary from its desired path.

Looking further at FIGS. 1A, 1B, 2 and 3, the cutting means 20 is also attached to the table member 22 by a third brace 41 of the frame 32. In the preferred embodiment, the cutting means 20 includes a backing structure 42 that is removeably attached to the third brace 41, and at least one cutting plate 44 that is in turn removeably attached to the backing structure 42. The cutting plate 44 and the backing structure 42 are thereby positioned on the third brace 41 in proximate relation to each other. Both the cutting plate 44 and the backing structure 42 include a cutting aperture 46 designed to sever any undesired attachments 26 from the periphery of the formed element 12. The cutting plate 44 may be mounted to the third brace 41 without the backing structure 42, but the backing structure 41 provides support for the cutting plate 44 in trimming formed elements 12.

Figure 4:
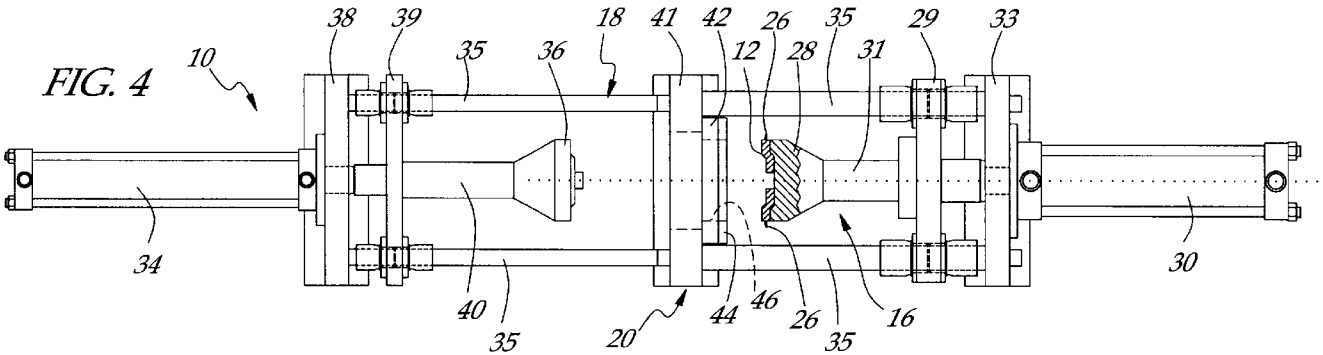
FIG. 4 is a top plan view of the apparatus for trimming formed elements of the present invention, wherein the formed element is placed in the nesting member.
Figure 5:
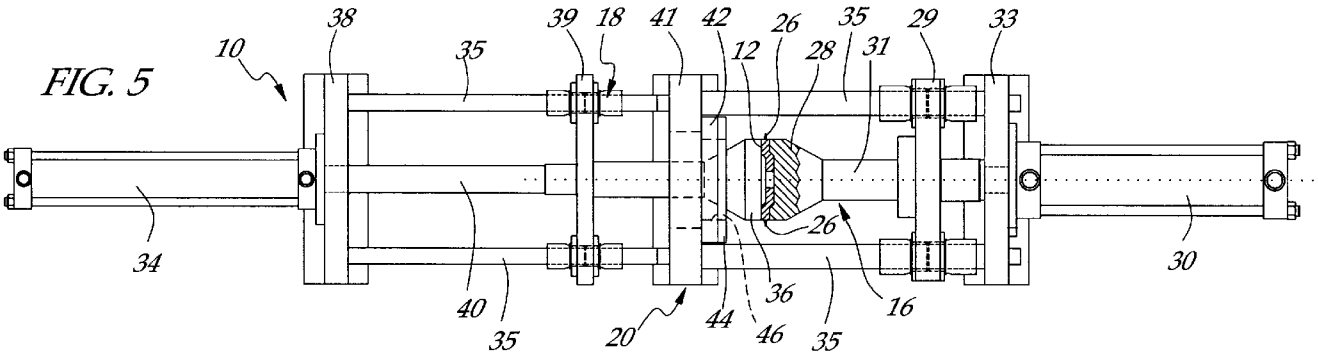
FIG. 5 is a top plan view of the apparatus for trimming formed elements of the present invention as illustrated in FIG. 4, wherein the clamping member is engaging the formed element in the nesting member.
Figure 6:
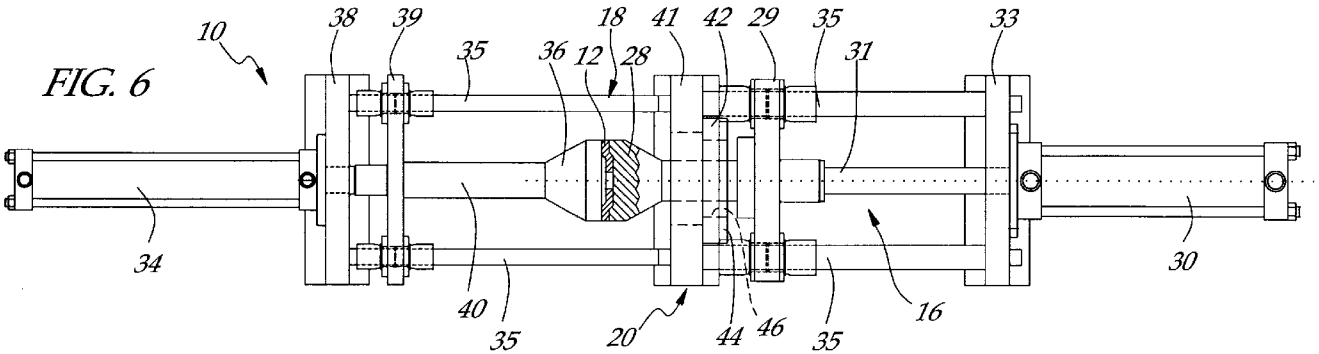
FIG. 6 is a top plan view of the apparatus for trimming formed elements of the present invention as illustrated in FIG. 4, wherein the nesting member, clamping member, and formed element have traversed the cutting means.
Figure 8:
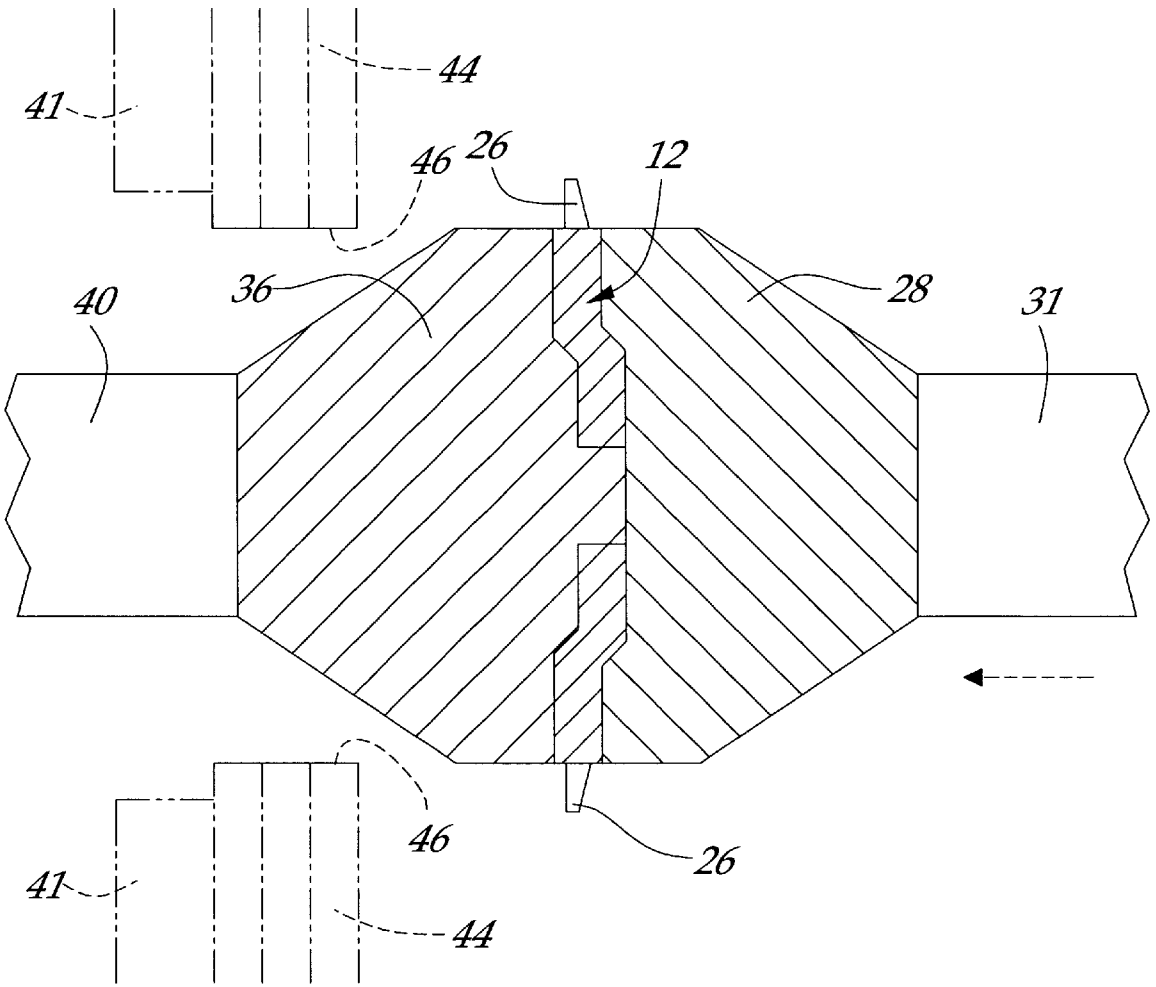
FIG. 8 is a sectional side view of a formed element positioned between the nesting member and clamping member of the present invention.

The process of trimming undesired attachments 26 from the periphery of the formed element 12 is illustrated in FIGS. 4 through 6. Looking at FIG. 4, the process begins with the formed element 12 being positioned with respect to the nesting member 28 of the formed element receiving means 16. Referring to FIG. 5, the clamping cylinder 34 then extends the clamping rod 40 toward the cutting means 20 such that the clamping member 36 traverses the cutting aperture 46 in the cutting plate 44 and backing structure 42. The clamping member 36 thereby comes into contact with the formed element 12 and applies a force to secure the formed element 12 between the nesting member 28 and the clamping member 36, such that the clamping member 36 and the nesting member 28 act as a vice to securely hold the formed element 12, as shown in FIG. 8.

The ram cylinder 30 then effectuates a force such that the ram cylinder rod 31 extends outward from the ram cylinder 30. The force of the ram cylinder 30 overpowers the force applied by the clamping cylinder 34, and thereby forces the clamping cylinder 34, the nesting member 28 and the secured formed element 12 toward the cutting means 20, as shown in FIG. 6. The nesting member 28 and the clamping member 36 are designed to traverse the cutting aperture 46 without making contact with the cutting aperture 46. Although the nesting member 28 and the clamping member 36 are able to traverse the cutting aperture 46, the periphery of the cutting aperture 46 is designed to be substantially similar in size and shape as the periphery of the formed element 12, or the cutting aperture is designed to be substantially similar to one side of the formed element 12, such that an undesired attachment 26 positioned on the periphery of the formed element 12 will be truncated from the formed element 12. As a result, as the ram cylinder 30 forces the clamping member 36, nesting member 28, and formed element 12 through the cutting aperture 46, only the undesired attachments 26 will make contact with the cutting plates 44 to remove the undesired attachments 26. Furthermore, since the clamping member 36 acts as a vice in conjunction with the nesting member 28, the formed element 12 is unable to roll or twist out of the secured position.

Once the formed element 12 has passed through the cutting aperture 46, the formed element 12 may be removed from the secured position between the nesting member 28 and the clamping member 36. After guiding the formed element 12 through the cutting plate 44, the clamping member 36 may be retracted such that the formed element 12 may fall away from the nesting member 28, or the formed element 12 may be extracted, such as with a robotic hand and arm (not shown) that may be maneuvered to engage and remove the formed element 12.

Figure 10:
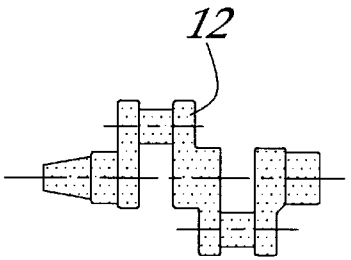
FIG. 10 is a front elevational view of a formed element to be trimmed using multiple cutting plates illustrated in FIGS. 9A–9C, the cutting plates being mounted to conform to variations in the formed element being trimmed.
Figure 9A:
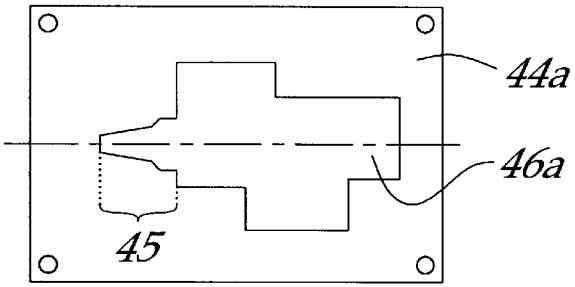
FIGS. 9A–9C are front elevational views of cutting plates having cutting apertures of varying designs to trim a formed element.
Figure 9B:
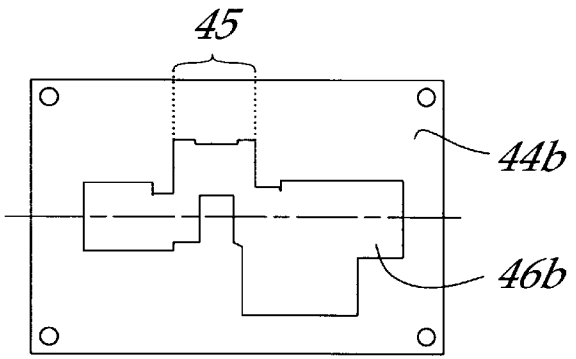
Figure 9C:
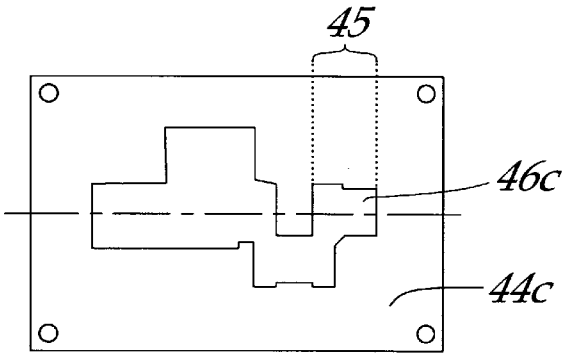

Looking at FIGS. 9A–9C, a series of cutting plates 44*a*, 44*b*, and 44*c* are illustrated having various outlines of cutting apertures 46*a*, 46*b*, and 46*c*. The cutting apertures 46*a*, 46*b*, and 46*c* illustrated in FIGS. 9A–9C are each designed with a specific cutting edge 45 to engage a specific portion of the formed element 12 sequentially, as shown in FIG. 10. As illustrated in FIGS. 9A–9C, the cutting apertures 46*a*, 46*b*, and 46*c* within the cutting plates 44*a*, 44*b*, and 44*c*may be varied according to the type of formed element 12 that is to be trimmed and the shape associated with that formed element 12, or the cutting apertures 46*a*, 46*b*, and 46*c* may be varied to have cutting edges 45 to engage the specific individual surfaces of the formed element 12 that are to be trimmed. Each cutting aperture 46*a*, 46*b*, and 46*c* is designed such that the clamping member 36 and the nesting member 28 will be able to traverse the cutting aperture 46*a*, 46*b*, and 46*c* without contacting the periphery of the cutting aperture 46*a*, 46*b*, and 46*c* while the desired surface or surfaces of the formed element 12 will engage the piercing edge of the cutting aperture 46*a*, 46*b*, and 46*c* such that the contact will trim and remove the undesired attachment 26 from the formed element 12. As a result, it is clear that the shape of the cutting member 36 and nesting member 28 may be varied also according to the formed element 12 that is to be trimmed.

Figure 11:
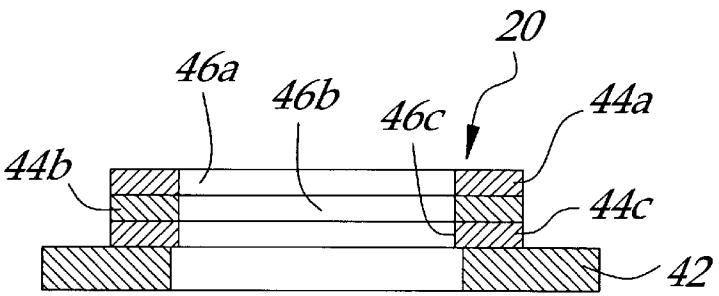
FIG. 11 is a side sectional view of the cutting means using each of the cutting plates illustrated in FIGS. 9A–9C to trim different sections of the formed element illustrated in FIG. 10.

Looking at FIG. 11, the cutting means 20 may include multiple cutting plates 44*a*, 44*b*, and 44*c* attached to the backing structure 42 either rigidly or loosely Each individual cutting plate 44*a*, 44*b*, and 44*c* may include a cutting aperture 46*a*, 46*b*, and 46*c* having a varied design (as shown in FIGS. 9A–9C) such that each cutting aperture 46*a*, 46*b*, and 46*c* will engage a different surface of the formed element 12. Therefore, by including multiple cutting plates 44*a*, 44*b*, and 44*c*, the user is able to engage the desired surface at separate times to avoid overstressing the cutting means 20 and aligning the cutting plates 44*a*, 44*b*, and 44*c* according to the variations of the formed element 12 at one time. Moreover, using multiple cutting plates 44*a*, 44*b*, and 44*c* allows the user to easily alter the cutting means 20 should the user not desire to engage one surface of the formed element 12 or should the shape of the formed element 12 be varied.

One advantage of the present invention is the easy substitution of one cutting plate 44 with another cutting plate 44 when the periphery of the cutting aperture 46 is dulled. Since each cutting plate 44 is removeably mounted to the backing structure 42 and frame 32, it may be replaced when the periphery of the cutting aperture 46 is not as sharp as desired. In the preferred embodiment, the mounted connection is made by bolts that engage the backing structure 42 when the cutting plate 44 gets dull, the bolts holding the cutting plate 44 may be removed, and the face of the cutting plate 44 may be sharpened. Furthermore, this apparatus 10 for trimming formed elements 12 is easily adaptable to a plurality of types of formed elements 12 that must be trimmed and cleaned before they can be used.

Figure 12:
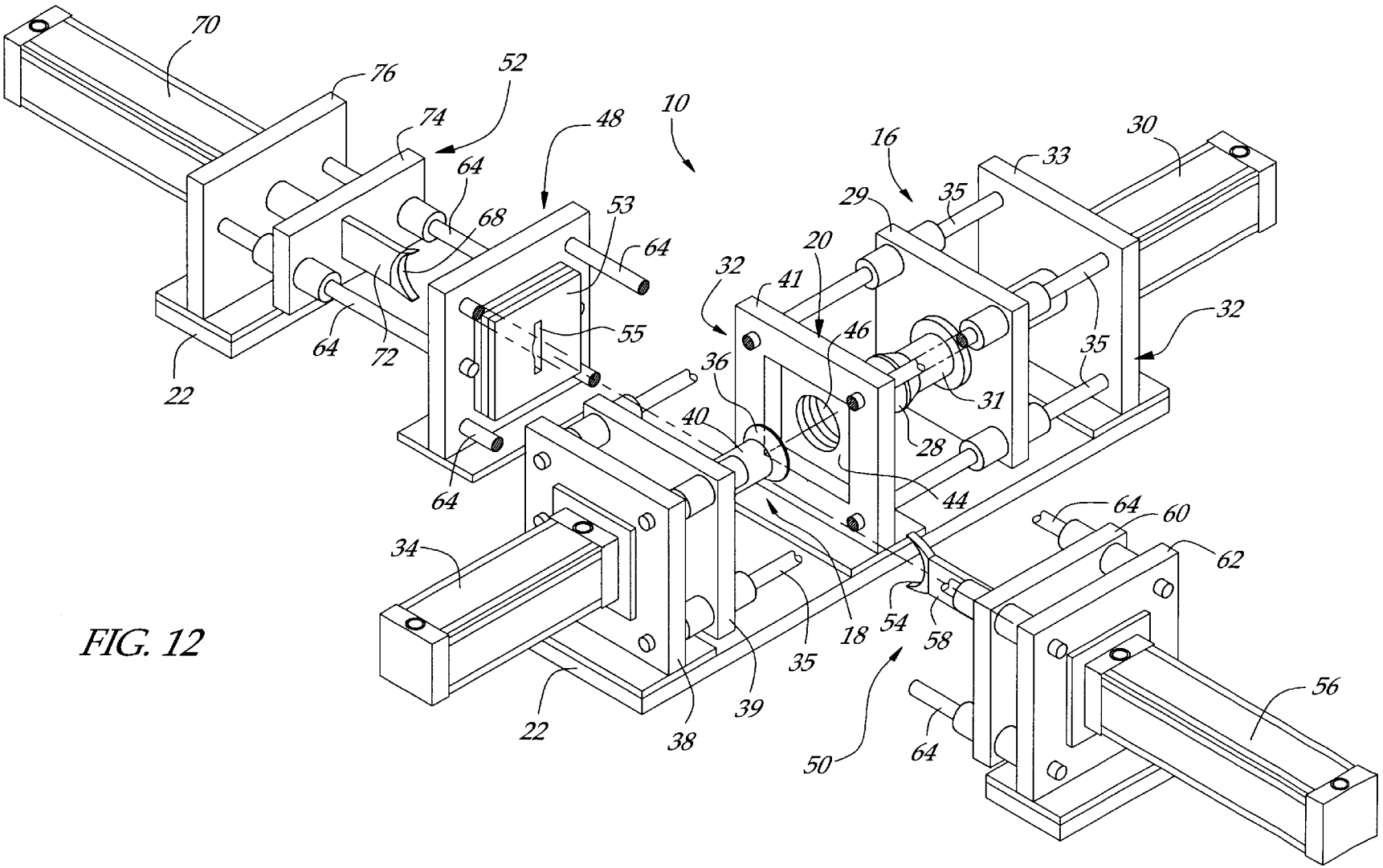
FIG. 12 is a front elevational view of a second embodiment of the apparatus for trimming formed elements used to trim formed elements in multiple dimensions.

A second embodiment of the apparatus 10 for trimming formed elements 12 is illustrated in FIG. 12. In this embodiment, the apparatus 10 for trimming formed elements 12 may be designed to trim undesired attachments 26 from the formed elements 12 in two dimensions as opposed to one dimension as described in the first embodiment above. In such an embodiment, the apparatus 10 for trimming formed elements 12, in addition to the embodiment described above, further includes an auxiliary cutting means 48 for trimming the undesired attachments 26 of the formed element 12 in the additional dimension. In such an embodiment, the formed element 12 is trimmed in the first dimension as described above. However, after the formed element 12 has traversed the cutting plate 44, the formed element 12 will then be engaged by an auxiliary formed element receiving means 50 and an auxiliary clamping means 52 for additional trimming at another angle.

The auxiliary formed element receiving means 50 and the auxiliary clamping means 52 are preferably positioned substantially perpendicular with respect to the nesting member 28 and the clamping member 36, although these formed elements are not exclusively positioned at a perpendicular angle. An auxiliary cutting plate 53 is thereby positioned between the auxiliary formed element receiving means 50 and the auxiliary clamping means 52 to engage various surfaces of the formed element 12 that were not previously engaged by the cutting means 20.

Similar to the embodiment described above, the auxiliary formed element receiving means 50 includes a secondary nesting member 54, a secondary ram cylinder 56, a secondary ram cylinder rod 58, and a secondary nesting positioning plate 60. A reinforcement brace 62 supports the secondary ram cylinder 56, which is a conventional hydraulic cylinder. The secondary ram cylinder rod 58 acts as a conventional piston rod used by the secondary ram cylinder 56, such that the secondary ram cylinder rod 58 is able to be linearly extended and retracted by the secondary ram cylinder 56.

The secondary nesting member 54 is attached to a cantilevered end of the secondary ram cylinder rod 58, and the secondary nesting member 54 is designed to securely and integrally grip the formed element 12. As a result, the secondary ram cylinder 56 will provide linear movement of the secondary ram cylinder rod 58 to extend and retract the secondary nesting member 54 holding the formed element 12. Additionally, the secondary nesting positioning plate 60 is slidably mounted on secondary guide rods 64 and serves as a support member for the secondary ram cylinder rod 58 such that the secondary ram cylinder rod 58 does not vary from its desired path.

The auxiliary clamping means 52 includes a secondary clamping member 68, a secondary clamping cylinder 70, a secondary clamping cylinder rod 72, and a secondary clamping positioning plate 74. A reinforcement brace 76 supports the secondary clamping cylinder 70, which is a conventional hydraulic cylinder. The secondary clamping cylinder rod 72 acts as a conventional piston rod used by the secondary clamping cylinder 70, such that the secondary clamping cylinder rod 72 is able to be linearly extended and retracted by the secondary clamping cylinder 70. The secondary clamping member 68 is attached to a cantilevered end of the secondary clamping cylinder rod 72, and the secondary clamping member 68 is designed to securely and integrally engage the formed element 12 and secondary nesting member 54. As a result, the secondary clamping cylinder 70 will provide linear movement of the secondary clamping cylinder rod 72 to extend and retract the secondary clamping member 68. Additionally, the secondary clamping positioning plate 74 is slidably mounted on the secondary guide rods 64 and serves as a support member for the secondary clamping cylinder rod 72 such that the secondary clamping cylinder rod 72 does not vary from its desired path.

The secondary clamping member 68 thereby traverses the secondary cutting aperture 55, and the secondary clamping member 68 and the secondary nesting member 54 thereby engage the formed element 12. The secondary ram cylinder 56 then effectuates a force such that the secondary ram cylinder rod 58 extends outward from the secondary ram cylinder 56. The force of the secondary ram cylinder 56 overpowers the force applied by the secondary clamping cylinder 70, and thereby forces the secondary clamping cylinder 70 and the formed element 12 secured between the secondary nesting member 54 and the secondary clamping member 68 towards the secondary cutting means 48. As with the first embodiment, the secondary nesting member 54 and the secondary clamping member 68 are designed to traverse the secondary cutting aperture 55 without making contact with the cutting aperture 55. Although the secondary nesting member 54 and the secondary clamping member 68 are able to traverse the secondary cutting aperture 55, the periphery of the secondary cutting aperture 55 is designed to be substantially similar in size and shape as the periphery of a second side of the formed element 12, or the cutting aperture is designed to be substantially similar to that side of the formed element 12, such that an undesired attachment 26 positioned on the periphery of the formed element 12 will be truncated from the formed element 12. As a result, as the secondary ram cylinder 56 forces the secondary clamping member 68, secondary nesting member 54, and formed element 12 through the secondary cutting aperture 55, only the undesired attachments 26 will make contact with the periphery of the secondary cutting apertures 55 to remove the undesired attachments 26. Finally, the trimmed formed element 12 will be available to be extracted in the manner that the user desires.

Thus, although there have been described particular embodiments of the present invention of a new and useful APPARATUS AND METHOD FOR TRIMMING FORMED ELEMENTS, it is not intended that such references be construed as limitations upon the scope of this invention except as set forth in the following claims.

What is claimed is:

1. An apparatus for removing undesired attachments from the periphery of a formed element, the apparatus comprising:

a base member having a proximal end and a distal end;

formed element receiving means to securely engage the formed element, said formed element receiving means attached to said distal end of said base member;

clamping means for securing the position of the formed element in said formed element receiving means, said clamping means being attached to said proximal end of said base member; and a cutting plate attached to said base member between said formed element receiving means and said clamping means, said cutting plate including a cutting aperture for engaging the undesired attachments on the formed element;

wherein said clamping means extends through said cutting aperture to support the formed element in said formed element receiving means; and wherein formed element receiving means forces said clamping means and the formed element through said cutting aperture of said cutting plate such that the undesired attachments of the formed element are removed by engaging said cutting aperture.

2. The apparatus as described in claim 1 wherein said cutting means includes a backing structure; and a cutting plate integrally connected to said backing structure;

said cutting aperture extending though said cutting plate and said backing structure.

3. The apparatus as described in claim 1 wherein said base member includes:

a table member; and a plurality of leg members attached to said table member to support said table member.

4. The apparatus as described in claim 1 wherein said formed element receiving means includes:

a ram cylinder;

a ram cylinder rod slidably mounted in said ram cylinder, said ram cylinder rod having a cantilevered end; and a nesting member attached to said cantilevered end of said ram cylinder rod to integrally receive the formed element.

5. The apparatus as described in claim 4 wherein said clamping means includes:

a clamping cylinder;

a clamping cylinder rod slidably mounted in said clamping cylinder, said clamping cylinder rod having a cantilevered end; and a clamping member attached to said cantilevered end of said clamping cylinder rod to integrally connect with said nesting member to secure the formed element between said clamping member and said nesting member.

6. The apparatus as described in claim 1 further comprising:

an auxiliary base member attachment having a forward and rearward end, said auxiliary base member attachment connected to said proximal end of said base member;

auxiliary formed element receiving means to securely engage the formed element, said auxiliary formed element receiving means attached to said rearward end of said auxiliary base member;

auxiliary clamping means attached to said forward end of said auxiliary base member; and auxiliary cutting means attached to said auxiliary base member between said auxiliary formed element receiving means and said auxiliary clamping means, said auxiliary cutting means including an auxiliary cutting aperture for engaging undesired attachments on the formed element;

wherein said auxiliary clamping means traverses said auxiliary cutting aperture to support the formed element in said auxiliary formed element receiving means; and wherein said auxiliary formed element receiving means forces said auxiliary clamping means and the formed element through said auxiliary cutting aperture such that the undesired attachments engage said cutting aperture.

7. The apparatus as described in claim 6 wherein said auxiliary formed element receiving means includes:

a secondary ram cylinder;

a secondary ram cylinder rod slidably mounted in said secondary ram cylinder, said secondary ram cylinder rod having a cantilevered end; and a secondary nesting member attached to said cantilevered end of said secondary ram cylinder rod to integrally receive the formed element.

8. The apparatus as described in claim 6 wherein said auxiliary cutting means includes a secondary backing structure; and a secondary cutting plate integrally connected to said secondary backing structure;

said auxiliary cutting aperture extending though said secondary cutting plate and said secondary backing structure.

9. The apparatus as described in claim 6 wherein said auxiliary clamping means includes:

a secondary clamping cylinder;

a secondary clamping cylinder rod slidably mounted in said secondary clamping cylinder, said secondary clamping cylinder rod having a cantilevered end; and a secondary clamping member attached to said cantilevered end of said secondary clamping cylinder rod to integrally connect with said secondary nesting member to secure the formed element between said secondary clamping member and said secondary nesting member.

10. An apparatus for removing undesired attachments from the periphery of a formed element, the apparatus comprising:

a support member having a proximal end and a distal end;

a ram cylinder connected to said proximal end of said support member, said ram cylinder including a ram cylinder rod having a cantilevered end extending toward said distal end of said support member from said ram cylinder;

a nesting member mounted to said cantilevered end of said ram cylinder rod, said nesting member fitted to integrally receive the formed element;

a clamping cylinder connected to said support member, said clamping cylinder including a clamping cylinder rod having a cantilevered end extended toward said proximal end of said support member from said clamping cylinder;

a clamping member mounted to said cantilevered end of said clamping cylinder rod;

a cutting plate mounted to said support member between said nesting member and said clamping member, said cutting plate including a cutting aperture;

wherein said clamping cylinder propels said clamping member to traverse said cutting aperture to support the formed element in said nesting member; and wherein said ram cylinder propels the formed element supported by said clamping member and said nesting member through said cutting aperture such that the undesired attachments of the formed element engage said cutting aperture.

11. The apparatus of claim 10 wherein said support member includes:

a table member;

a frame mounted to said table member; and a plurality of leg members attached to said table member to support said table member.

12. The apparatus of claim 10 wherein further comprising:

an auxiliary base member attachment having a forward and rearward end, said auxiliary base member attachment connected to said proximal end of said base member;

auxiliary formed element receiving means to securely engage the formed element, said auxiliary formed element receiving means attached to said rearward end of said auxiliary base member;

auxiliary clamping means attached to said forward end of said auxiliary base member; and auxiliary cutting means attached to said auxiliary base member between said auxiliary formed element receiving means and said auxiliary clamping means, said auxiliary cutting means including an auxiliary cutting aperture for engaging undesired attachments on the formed element;

wherein said auxiliary clamping means traverses said auxiliary cutting aperture to support the formed element in said auxiliary formed element receiving means; and wherein said auxiliary formed element receiving means forces said auxiliary clamping means and the formed element through said auxiliary cutting aperture such that the undesired attachments engage said cutting aperture.

13. The apparatus as described in claim 12 wherein said auxiliary formed element receiving means includes:

a secondary ram cylinder;

a secondary ram cylinder rod slidably mounted in said secondary ram cylinder, said secondary ram cylinder rod having a cantilevered end; and a secondary nesting member attached to said cantilevered end of said secondary ram cylinder rod to integrally receive the formed element.

14. The apparatus as described in claim 12 wherein said auxiliary cutting means includes a secondary backing structure; and a secondary cutting plate integrally connected to said secondary backing structure;

said auxiliary cutting aperture extending though said secondary cutting plate and said secondary backing structure.

15. The apparatus as described in claim 12 wherein said auxiliary clamping means includes:

a secondary clamping cylinder;

a secondary clamping cylinder rod slidably mounted in said secondary clamping cylinder, said secondary clamping cylinder rod having a cantilevered end; and a secondary clamping member attached to said cantilevered end of said secondary clamping cylinder rod to integrally connect with said secondary nesting member to secure the formed element between said secondary clamping member and said secondary nesting member.

* * * * *